United States Patent [19]

Delany

[11] 4,119,205

[45] Oct. 10, 1978

[54] PALLETIZED CONTAINERS

[75] Inventor: Paul Nigel Delany, Hockley, England

[73] Assignee: Delpack Limited, Hockley, England

[21] Appl. No.: 817,659

[22] Filed: Jul. 21, 1977

[30] Foreign Application Priority Data

Jul. 22, 1976 [GB] United Kingdom ..... 30567/76
Nov. 2, 1976 [GB] United Kingdom ..... 45424/76

[51] Int. Cl.[2] ..... B65D 19/36

[52] U.S. Cl. ..... 206/598; 108/56.3; 206/600; 229/23 R

[58] Field of Search ..... 229/23 R, 23 C; 206/386, 597, 598, 599, 600; 217/43 A; 108/55.1, 55.5, 56.1, 56.3

[56] References Cited

U.S. PATENT DOCUMENTS

| | | | |
|---|---|---|---|
| 2,494,730 | 1/1950 | Thursby | 108/55.1 |
| 2,576,715 | 11/1951 | Farrell | 108/55.1 |
| 2,692,747 | 10/1954 | Strauss | 108/56.3 |
| 2,902,199 | 9/1959 | Breton | 206/386 |
| 3,026,015 | 3/1962 | Severn | 206/600 |
| 3,069,059 | 12/1962 | Desbois | 108/55.1 |
| 3,302,853 | 2/1967 | Locke | 229/39 R |
| 3,746,243 | 7/1973 | Young | 229/37 R |
| 3,858,526 | 1/1975 | Lombard et al. | 206/386 |
| 3,940,101 | 2/1976 | Heidelbach | 108/56.3 |

FOREIGN PATENT DOCUMENTS

| | | | |
|---|---|---|---|
| 697,232 | 9/1953 | United Kingdom | 108/56 A |

*Primary Examiner*—William Price
*Assistant Examiner*—Bruce H. Bernstein
*Attorney, Agent, or Firm*—Seidel, Gonda & Goldhammer

[57] ABSTRACT

A palletized container comprises a case of folded corrugated board with strengthened parallel feet extending beneath the case to enable the container to be lifted by a fork-lift vehicle. The feet are made from lengths of corrugated board folded into a rectangular configuration and rolled around tongues which are formed from the bottom flaps of the case, thereby interlocking the case and the feet without any need for stitching or glueing of the parts. The security of the container is achieved by the interleaving of the corrugated board pieces.

9 Claims, 3 Drawing Figures

PALLETIZED CONTAINERS

FIELD OF THE INVENTION

This invention relates to palletised containers, that is containers having an integral pallet.

The increasing shipment of goods in containers made for example from corrugated board material makes it desirable for the individual containers to have their own integral pallets so that they can readily be lifted, for example by a fork-lift truck. With an integral case and pallet construction the pallet remains with the case during transportation, thereby avoiding the use of separate conventional pallets which are relatively expensive and which may have to be returned for re-use.

SUMMARY OF THE INVENTION

It is an object of the present invention to provide a palletised container which can be readily assembled and which provides a strong and secure structure.

In accordance with the invention there is provided a palletised container comprising a case formed from one or more pieces of foldable packaging material, and a pallet secured to the base of the case and comprising at least two parallel supports defining a channel therebetween to receive the forks of a fork-lift vehicle, characterised in that two opposed sides of the case have bottom flaps which are divided to define a foldable tongue at each end of each side flap, and that a pallet support is associated with each pair of opposed tongues and comprises an elongate member folded around said opposed tongues to define a hollow tube for support means.

Preferably, the container includes a central pallet support provided between said outer pallet supports and comprises an elongate element folded to define a hollow tube for support means and a pair of flaps extending one to each side of the hollow tube and interlocked between the bottom flaps of the case and flaps constituting part of the outer pallet supports.

According to a preferred feature each of the tongues is provided with a pair of parallel score lines across its width adjacent to the junction of the tongue with the case side to enable the outer pallet supports to be folded around the tongues.

The material from which the case or container is formed may be for example a fibreboard material, such as a triple-fluted fibreboard material for particularly heavy duty containers or double-walled corrugated board for more normal applications.

The support means within the pallet supports are preferably struts of high density polystyrene, although alternative materials may be substituted. It is also possible to use a pair of blocks, one at each end of each pallet support, instead of full-length struts.

Although in the preferred embodiment described hereinafter the container is provided with three pallet supports, and indeed this is preferred, it may be possible to dispense with the central pallet support if additional strapping is used and if the load to be carried is relatively small.

One of the main advantages of the integrated case and pallet of the present invention is the fact that the provision of the pallet parts involves no additional stitching or glueing of parts to the case, the parts defining the pallet being folded and fitted in interlocking engagement with portions of the case. The container can be delivered to the assembly point as a flat 'kit of parts' and can then be assembled easily when required.

DETAILED DESCRIPTION OF THE DRAWINGS

A preferred embodiment of the invention will now be described in detail by way of example and with reference to the accompanying drawings, in which.

DESCRIPTION OF THE PREFERRED EMBODIMENT

Figure 1:
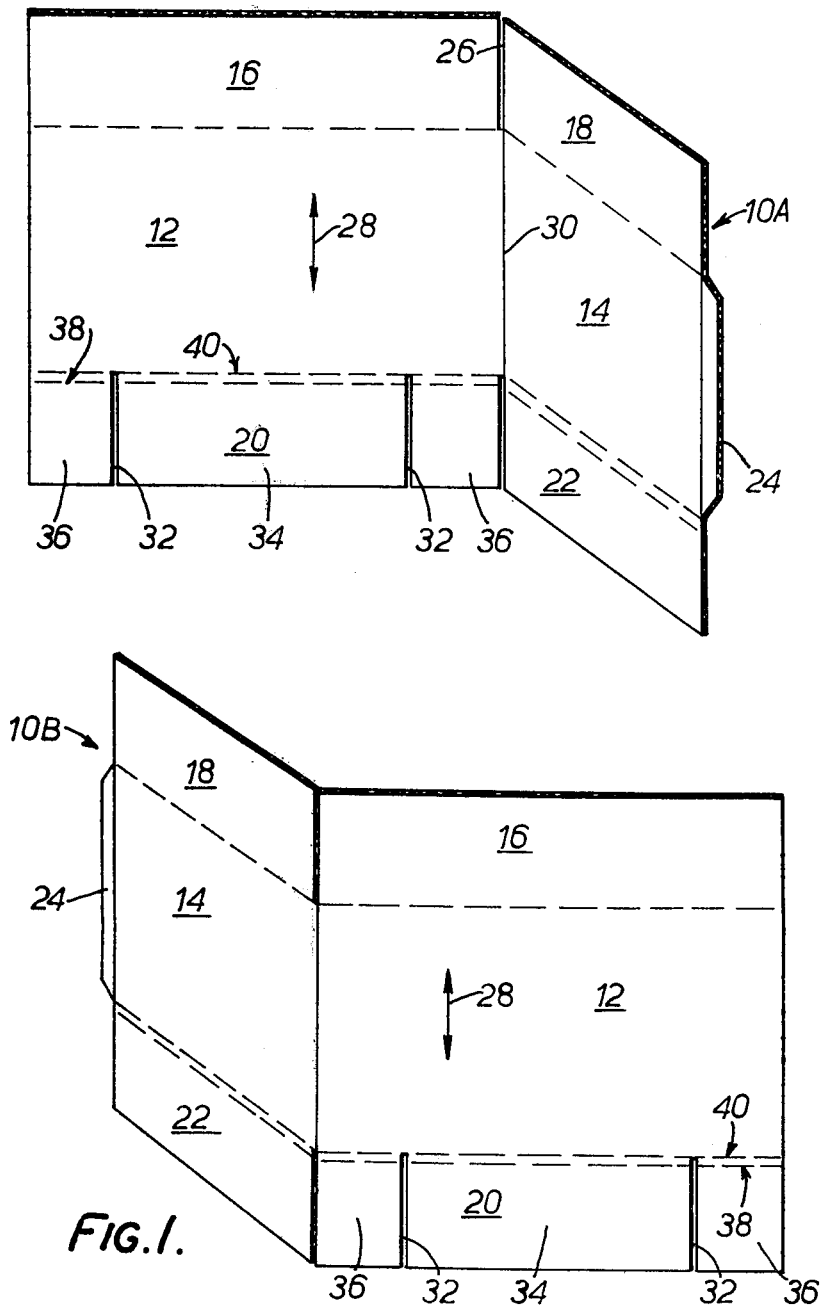
FIG. 1 is a view of the two pieces of a two-part case for making a palletised case according to the invention, prior to assembly.

Referring first to FIG. 1, this shows the two pieces 10A and 10B from which the case is made. It is possible to produce a palletised case from a one-piece blank of corrugated board, but due to the large dimensions of many of these cases which are required for long-distance transportation, many conventional machines are unable to produce one-piece blanks of the necessary size. The two blanks 10A and 10B are made of corrugated board, usually single-wall or double-wall board. However, any packaging material that can be formed into a case as described hereinafter may alternatively be used.

Each case piece 10A, 10B comprises a blank which is cut and scored to define a side 12, an end 14, a top side flap 16, a top end flap 18, a bottom side flap 20, and a bottom end flap 22. A stitching flap 24 is provided along the free edge of the end 14. A slot 26 divides the top side flap 16 from the top end flap 18. The score lines are indicated by the broken lines in FIG. 1 and extend at right angles to the corrugations in the board, the direction of which is indicated by the arrows 28. The line 30 between the side 12 and the end 14 represents a fold. All the score lines are formed on that face of the blank which when the case is assembled and closed will be towards the inside of the case.

An essential feature of the case blank used for the palletised container of the present invention is the provision of a pair of slots 32 in the bottom side flap of each piece 10A, 10B. These slots 32 extend fully across the bottom side flap 20 and may be for example of the order of 6 mm in width. The provision of these slots 32 divides the bottom side flap 20 into a central flap 34 and a pair of tongues 36. Each blank 10A, 10B is also provided with a score line 38 running the full length of the bottom side flap 20 and bottom end flap 22. This score line 38 is spaced from the adjacent score line 40 by a distance which is substantially equal to twice the thickness of the board which is used for the pallet portions of the container, which will be referred to hereinafter. Normally, this will be the same thickness of board as is used for the blanks 10A and 10B. The provision of this additional score line 38, as will become apparent hereinafter when the assembly of the palletised container is described, is primarily to enable the tongues 36 to be able to fold on two adjacent lines separated by a distance approximately equal to two thicknesses of the board. The provision of the score line 38 across the centre flap 34 and across the bottom end flap 22 is not essential, although in practice it is easier to provide the score 38 straight across the whole blank 10A, 10B than to score only the two tongues 36.

Figure 2:
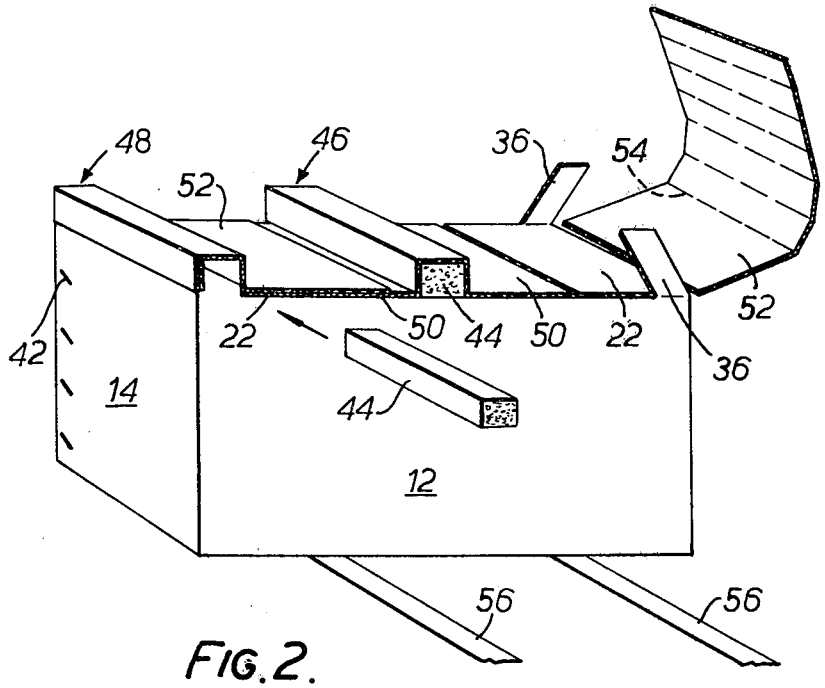
FIG. 2 shows the palletised case according to the invention when substantially assembled; and, FIG. 3 is a sectional view through one of the outer support holders of the case.

FIG. 2 shows the palletised case partially assembled. The two blanks 10A, 10B of FIG. 1 are first stitched or glued together by means of the flaps 24. When assembled, the flaps 24 lie inside the side piece 12 of the other blank 10A or 10B. A set of metal stitches 42 is shown in FIG. 2. In FIG. 2 the case is shown upsidedown with the top flaps 16 and 18 folded under. The basic case is provided with an integral pallet by the use of three pallet parts which extend parallel to each other across the width of the case. Each of the three pallet parts defines a hollow tube which is arranged to receive a pallet strut 44 extending the full width of the case, or a pair of blocks positioned one at each end of the hollow tube. The strut or blocks 44 are preferably made of high density expanded polystyrene, although other strong lightweight materials may be used. In FIG. 2 the centre support holder 46 and one of the two outer support holders 48 are shown in their assembled positions, and the other outer support holder shown ready for assembly. As will be appreciated from FIG. 2, the dimension of the pallet strut 44 in at least the two outer support holders 48 in the direction along the length of the case is equal to the width of the tongue 36 in the same direction.

The centre support holder 46 comprises a board with the corrugations running along the length of the case and scored across the corrugations on four parallel lines, thereby to define a rectangular hollow tube which is open on one side and which has a pair of horizontally extending flanges 50.

Figure 3:
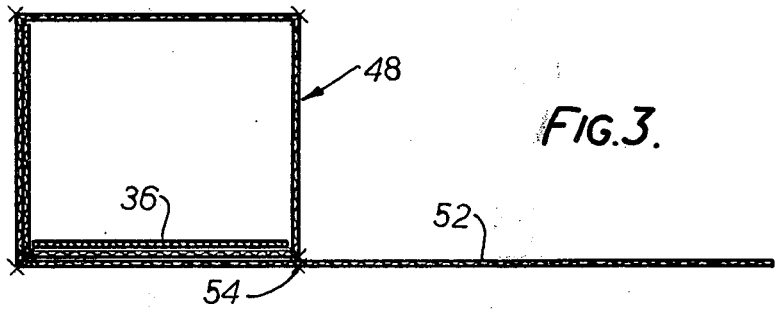

Each of the outer support holders 48 comprises a length of corrugated board, preferably of single or double wall material, scored across the corrugations on for example six lines as indicated by the small crosses in FIG. 3. The scores are towards one end of each board, leaving a relatively long flap 52 free from scores. As will be seen from FIGS. 2 and 3, the outer support holders 48 are designed to roll up to form a rectangular hollow tube enclosing the folded-down tongues 36 of the case. A score 54 is preferably provided at the end of the flap 52 adjacent to the rolled up portion of the board in order to enable the board to be rolled around the tongues 36 more easily during assembly. As will be seen from FIG. 3, each of the outer support holders 48 has sufficient folded sections that a double thickness of board is provided both beneath the tongues 36 and on the outside wall remote from the flap 52.

The assembly of the palletised case is as follows. After the stitching or glueing of the two pieces 10A and 10B the case is inverted as shown in FIG. 2 and the central portions 34 of the two bottom side flaps 20 are first folded down. The two bottom end flaps 22 are then folded down to overlie the flaps 34. At this stage the four tongues 36 remain free and are not folded down. The two outer support holders 48 are then each folded around the respective tongues 36, the extended flap 52 on each outer support holder 48 overlying and extending beyond the respective bottom end flap 22. Thereafter, the centre support holder 46 can be pushed into place with the flanges 50 sliding under the extended flaps 52 of the outer support holders and thereby being sandwiched between these flaps 52 and the central portions 34 of the bottom side flaps 20. The dimensions of the central support holder 46, and in particular the length of its flanges 50, are arranged to be such that when assembled the flanges 50 meet the end face of the respective bottom end flaps 22 beneath the overlying flaps 52 of the outer support holders. This provides additional strength to the assembled case. Finally, the struts or blocks 44 are pushed into place within the support holders 46, 48. The struts or blocks are held securely in place by the weight of the items placed within the case. When the case is ready for closure two tapes or straps 56 are passed around the case to ensure that the flanges 50 of the centre support holder 46 are held in position sandwiched between the case flaps 34 and the flaps 52 of the outer support holders 48.

It will be appreciated that the three pallet parts thus remain in position throughout transit and form an integral part of the container. The width of the tongues 36 is made to match the width of the struts or blocks 44 of the pallet. The score line 38 across the tongues enables the tongues to be folded down over the flaps 22 and enables the outer support holder then to be folded around the tongues.

I claim:

1. A palletized container comprising a case formed from at least one piece of foldable packaging material, the case having two opposed ends each with a bottom flap, two opposed sides each with a bottom flap which is divided to define a foldable tongue at each end of each said flap, said tongues being located outside the bottom flaps of said opposed ends, and a separate pallet secured to the base of the case and comprising two parallel pallet supports defining a channel therebetween to receive the forks of a fork-lift vehicle, each pallet support comprising an elongate member folded over and around an opposed pair of said tongues to define a hollow tube encircling said tongues, and support means within said tubes to maintain their shape.

2. A container as claimed in claim 1, in which each of said tongues is provided with a pair of parallel score lines across its width adjacent to the junction of the tongue with the case side to enable the outer pallet supports to be folded around the tongues.

3. A container as claimed in claim 2, in which the score lines are spaced by a distance substantially equal to twice the thickness of the material constituting the outer pallet supports.

4. A container as claimed in claim 2 wherein the pair of parallel score lines extend the full length of the material from which the case is assembled.

5. A container as claimed in claim 1, in which the bottom flaps of the case sides are slotted to the depth of the flaps at equal distances from each end of each flap to form said tongues, the width of the tongues being substantially equal to one dimension of the support means in the outer pallet supports.

6. A container as claimed in claim 1, in which said support means comprises struts of polystyrene.

7. A container as claimed in claim 1, in which each elongate member of said pallet supports comprises a length of corrugated board scored across the line of the corrugations on six lines whereby the elongate member when folded into a rectangular configuration provides a double thickness of board on two sides of the rectangle.

8. A palletized container comprising a case formed from at least one pace of foldable packaging material, the case having two opposed sides each with a bottom flap which is divided to define a foldable tongue at each end of said flap, a pallet secured to the base of the case and comprising two parallel pallet supports defining a channel therebetween to receive the forks of a fork-lift vehicle, each pallet support comprising an elongate member folded around an opposed pair of said tongues to define a hollow tube, support means within said tubes to maintain their shpae, a central pallet support between said outer pallet supports, said outer pallet supports each having a flap extending toward the central pallet support, said central pallet support comprising an elongate element folded to define a hollow tube with a pair of flaps extending one to each side of the hollow tube and interleafed between the bottom flaps of the case and said flaps of the outer pallet supports.

9. A container as claimed in claim 8, in which the free edges of the flaps of the central pallet support parallel to its fold lines abut respective edges of the bottom flaps of the case which are folded under said tongues.

* * * * *